United States Patent [19]

Volfson

[11] Patent Number: 4,826,044

[45] Date of Patent: May 2, 1989

[54] DISPENSER FOR VISCOUS FLUIDS

[75] Inventor: Boris Volfson, Maumee, Ohio

[73] Assignee: Owens-Illinois Closure Inc., Toledo, Ohio

[21] Appl. No.: 204,139

[22] Filed: May 31, 1988

[51] Int. Cl.[4] ..... B65D 35/22

[52] U.S. Cl. ..... 222/94; 222/145

[58] Field of Search ..... 222/207, 209, 212, 256, 222/257, 259, 260, 340, 341, 383, 386, 387, 380, 381, 405, 94, 129, 145, 464

[56] References Cited

U.S. PATENT DOCUMENTS

| | | | |
|---|---|---|---|
| 2,789,731 | 4/1957 | Marraffino | 222/94 |
| 2,914,220 | 11/1959 | Marraffino | 222/94 |
| 2,918,199 | 12/1959 | Marraffino | 222/94 |
| 2,944,704 | 7/1960 | Taylor | 222/94 |
| 4,340,154 | 7/1982 | VanManen | 222/94 |
| 4,461,403 | 7/1984 | Prahs | 222/129 |
| 4,708,267 | 11/1987 | Sieverding et al. | 222/211 |

*Primary Examiner*—Joseph J. Rolla
*Assistant Examiner*—S. Reiss

[57] ABSTRACT

A dispenser for dual extrusion of striped viscous fluids such as toothpaste or the like comprising a container having an opening, an axially collapsible sleeve insert inserted in the opening, and a piston engaging one end of the sleeve insert. The container is adapted to contain a first viscous material which extends into the sleeve. A second viscous fluid material is provided about the sleeve. The sleeve has a first set of openings at one end adjacent the piston for passage for the first viscous fluid material and a second set of openings therein spaced from the first set of openings and adjacent the opening in the container. Ribs are provided adjacent the other end of the sleeve insert and adjacent the second set of openings for guiding the second material into dual striping extrusion with the first material.

4 Claims, 2 Drawing Sheets

DISPENSER FOR VISCOUS FLUIDS

This invention relates to striping dispensers for dual extrusion of striped viscous fluids such as toothpaste or the like.

BACKGROUND AND SUMMARY OF THE INVENTION

In the dispensing of viscous fluid for dual extrusion to produce a striped output such as for striped toothpaste, it has become common to utilize a piston in a container that is movable to dispense a primary portion from a first chamber and a second portion from a second chamber, the two portions blending to form a striped product. A typical arrangement is shown in U.S. Pat. No. 4,461,403. Such dispensers utilize a chamber for the first component or portion and a small chamber for the second component or portion, the latter being made by a rigid or integral insert within the container.

The size of the insert determines not only the amount of material which can be dispensed from the second chamber but also the amount of material dispensed from the first chamber since the insert functions as a stop for the moving piston.

Among the objectives of the present invention are to provide a dispenser which utilizes an axially compressible sleeve insert permitting a larger amount of the striping material to be dispensed and at the same time permitting substantially more of the material to be dispensed from the second chamber, thus minimizing the amount of unused material left within the container after the sleeve moves to its maximum position.

In accordance with the invention, a dispenser for dual extrusion of striped viscous fluids such as toothpaste or the like comprises a container having an opening, an axially collapsible sleeve insert inserted in the opening, and a piston engaging one end of the sleeve insert. The container is adapted to contain a first viscous material which extends into the sleeve. A second viscous fluid material is provided about the sleeve. The sleeve has a first set of openings at one end adjacent the piston for passage for the first viscous fluid material and a second set of openings therein spaced from the first set of openings and adjacent the opening in the container. Ribs are provided adjacent the other end of the sleeve insert and adjacent the second set of openings for guiding the second material into dual striping extrusion with the first material.

DESCRIPTION

Figure 1:
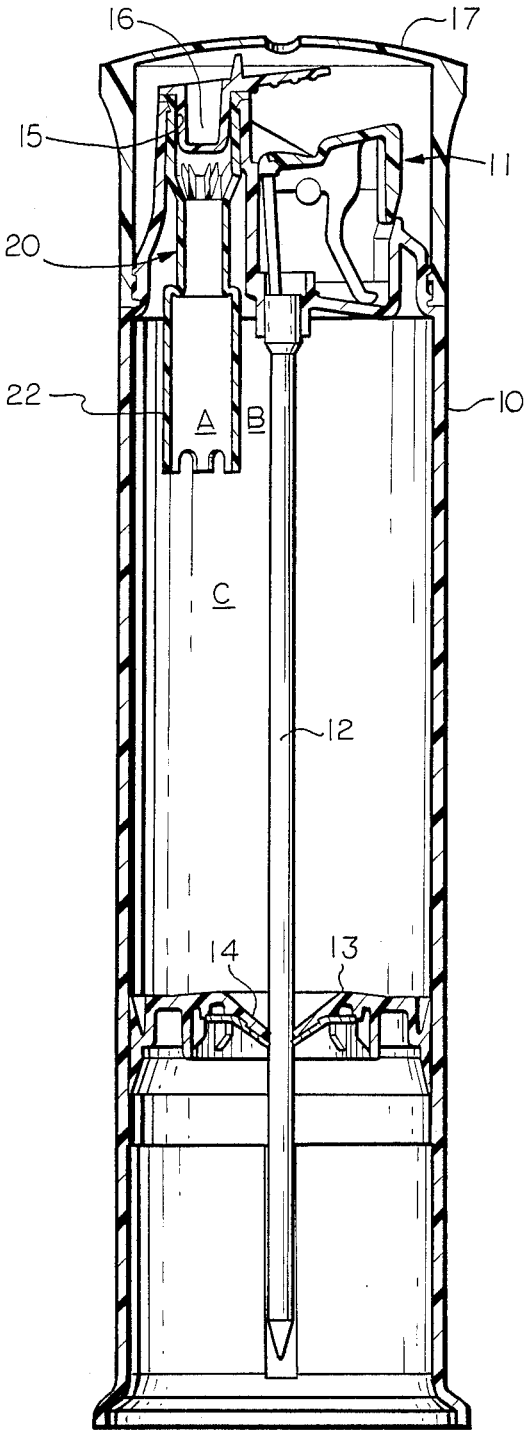
FIG. 1 is a longitudinal sectional view of a dispenser embodying the invention.

Referring to FIG. 1, the dispenser embodying the invention comprises a tubular container 10 of plastic or the like having the upper end thereof closed by an activating mechanism 11 that functions to reciprocate a piston rod 12 and progressively move a piston 13 through a one-way ratchet or clutch mechanism 14 so that successive operation of the activating mechanism

11 progressively causes causes the piston to move upwardly toward a dispensing opening 15. A cap 16 normally closes the opening 15 and a cover 17 is removably mounted on the container.

Figure 2:
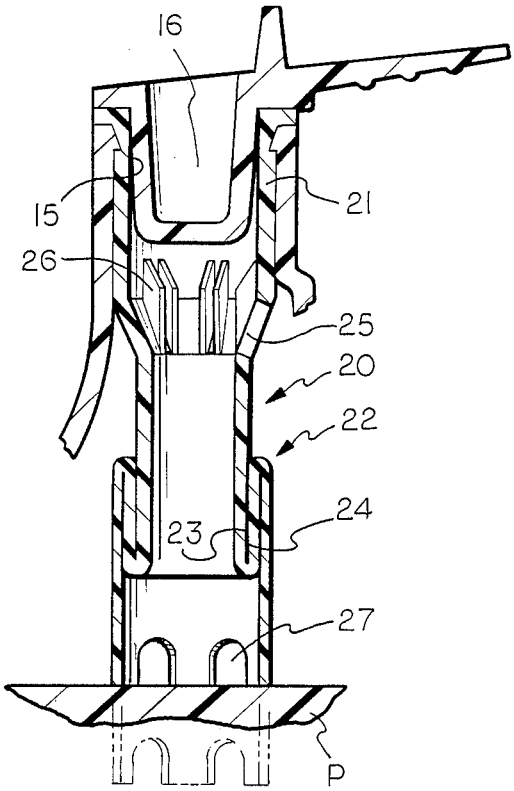
FIG. 2 is a fragmentary view of a portion of the dispenser showing the parts in a different operative position.

In accordance with the invention, as shown in Figs. 1 and 2, an insert 20 is positioned in the opening 15 and has an upper end 21 telescoped within the opening and a lower end 22 that is axially compressible in the form of a rolling sleeve that has portions 23, 24 that roll relative to one another to make the sleeve compressible.

The area B surrounding the insert 20 defines a secondary chamber for the secondary striping material and the sleeve 22 in its extended position forms a chamber A for the primary viscous material which communicates with the area C, below the open lower end of sleeve 22, and is also filled with the primary material. The primary material also surrounds the lower end of the sleeve 20. The primary material usually fills the area A within the sleeve 22 of insert 20 as well as the area C below the sleeve 22. The secondary material fills the area B about the sleeve 22 part way along the sleeve but spaced from the lower end of the sleeve 22. The upper end of the insert 20 is formed with circumferentially spaced openings 25 and circumferentially spaced ribs 26 are disposed within the upper end portion 21 adjacent the openings 25 to serve to guide the material from chamber A along striped portions formed by the ribs 26. The lower end of the sleeve 22 is also formed with openings 27 permitting portions of the base material to flow from chamber B into chamber A as the piston P engages the lower portion of the insert 20 and moves to collapse the sleeve 22.

Figure 3:
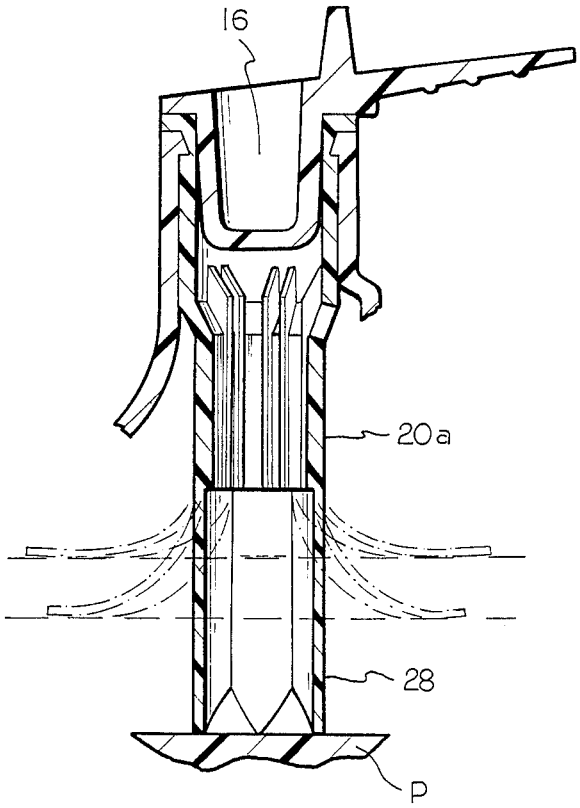
FIG. 3 is a sectional view of a modified form of dispenser.

In the form shown in FIG. 3, the insert 20a is made collapsible by a plurality of axially extending leaves 28 integral with the body of the sleeve and adapted to flare outwardly as the piston moves upwardly.

I claim:

1. A dispenser for dual extrusion of striped viscous fluids such as toothpaste or the like comprising a container having an opening, an axially collapsible sleeve insert inserted in said opening, a piston disposed at an end of said container opposite said opening and movable to engage one end of said sleeve insert, said container being adapted to contain a first viscous fluid material within said sleeve and below said sleeve, and a second viscous material about said sleeve, said sleeve having a first set of openings therein spaced from a second set of openings disposed adjacent said opening in the container.

2. The dispenser set forth in claim 1 including ribs adjacent said second set of openings in said sleeve insert for guiding said second material into dual striping extrusion with said first material.

3. The dispenser set forth in claim 1 wherein said axially collapsible sleeve comprises an intermediate rolling sleeve portion including portions that are adapted to roll upon one another.

4. The dispenser set forth in claim 1 wherein said axially collapsible sleeve insert comprises a plurality of axially extending fingers that are adapted to flex radially outwardly upon engagement by the piston upon its movement toward the dispensing opening.

* * * * *